US008888501B2

(12) United States Patent
Hirata et al.

(10) Patent No.: US 8,888,501 B2
(45) Date of Patent: Nov. 18, 2014

(54) ELECTRICAL CONNECTOR AND CONNECTOR

(75) Inventors: Toshihisa Hirata, Yamato (JP); Yusuke Nukanobu, Yamato (JP)

(73) Assignee: Molex Incorporated, Lisle, IL (US)

( * ) Notice: Subject to any disclaimer, the term of this patent is extended or adjusted under 35 U.S.C. 154(b) by 23 days.

(21) Appl. No.: 13/395,852

(22) PCT Filed: Sep. 14, 2010

(86) PCT No.: PCT/US2010/048767
§ 371 (c)(1),
(2), (4) Date: May 31, 2012

(87) PCT Pub. No.: WO2011/032146
PCT Pub. Date: Mar. 17, 2011

(65) Prior Publication Data
US 2013/0130555 A1 May 23, 2013

(30) Foreign Application Priority Data
Sep. 14, 2009 (JP) ..... 2009-211771

(51) Int. Cl.
*H01R 12/00* (2006.01)
*H01R 12/71* (2011.01)
*H01R 13/46* (2006.01)

(52) U.S. Cl.
CPC ..... *H01R 13/46* (2013.01); *H01R 12/716* (2013.01)
USPC ..... 439/60

(58) Field of Classification Search
CPC ..... H01R 23/688
USPC ..... 439/108, 60, 637, 636, 405
See application file for complete search history.

(56) References Cited

U.S. PATENT DOCUMENTS

| | | | | |
|---|---|---|---|---|
| 5,803,752 | A | 9/1998 | McHugh | |
| 6,068,494 | A | 5/2000 | Tokuwa | |
| 7,037,117 | B2 * | 5/2006 | Goto | 439/74 |
| 7,833,024 | B2 | 11/2010 | Takeuchi et al. | |
| 2007/0281519 | A1 | 12/2007 | Shiroyama | |
| 2007/0298657 | A1 * | 12/2007 | Ju | 439/607 |

FOREIGN PATENT DOCUMENTS

| | | |
|---|---|---|
| JP | 09-180829 | 7/1997 |
| JP | H07-337268 | 7/1997 |
| JP | 3320366 | 4/2000 |
| JP | 2002-262567 | 2/2004 |
| JP | 2004-103354 | 4/2004 |
| JP | 3966414 | 3/2005 |
| WO | WO 2007/016706 A2 | 2/2007 |

OTHER PUBLICATIONS

International Search Report for PCT/US2010/048767.

* cited by examiner

*Primary Examiner* — Phuongchi T Nguyen
(74) *Attorney, Agent, or Firm* — Timothy M. Morella

(57) ABSTRACT

There is provided an electrical connector including; a first connector having a first housing, a second connector which is mated with the first connector to be electrically connected thereto, a plurality of first connector terminals which are attached to the first housing, a plurality of through-holes which are formed in the first housing so as to be arranged in a predetermined direction and into which the first connector terminals are inserted; and a recess formed adjacently to the through-holes in the first housing. Accordingly, appearance of crack is suppressed even after the contact terminals are pressed-in by suppressing appearance of weld lines in the vicinity of through-holes.

9 Claims, 14 Drawing Sheets

ELECTRICAL CONNECTOR AND CONNECTOR

REFERENCE TO RELATED APPLICATIONS

The Present Application claims priority to prior-filed Japanese Application No. 2009-211771, entitled "Electrical Connector And Connector," and filed Sep. 14, 2009, the contents of which is fully incorporated in its entirety herein.

BACKGROUND OF THE PRESENT APPLICATION

The Present Application relates to a connector. In particular, the Present Application relates to an electrical connector for electrically connecting a board to a board.

An electrical connector such as a board-to-board connector has been hitherto known, which electrically connects boards arranged in parallel to each other or perpendicularly to each other. The board-to-board connector is provided with a pair of connectors which are attached to both of the boards to be connected. The respective connectors are electrically connected to the respective boards. One board and the other board are electrically connected to each other by the electric connection brought about between the connectors. The electrical connection between the boards and the connectors and the electrical connection between the connectors are performed by a plurality of contacts or contact terminals (connector terminals) which are provided on the respective connectors. The board and the connector are electrically connected to each other by soldering the contact terminals to the board. The connectors are electrically connected to each other by the elastic contact brought about between the contact terminals soldered to the respective boards. As disclosed in Japanese Patent Application No. 09-180829, the fitting or mating between the connectors is retained by the elastic contact brought about between the contact terminals described above.

Grooves and through-holes, which are used to attach the contact terminals, are formed for a housing of the connector. The housing of the connector is molded, for example, by the injection molding with an insulative material such as synthetic resin or the like.

When the housing, in which the through-holes are formed, is molded by the injection molding, weld lines appear in the vicinity of the through-holes. The weld line is a thin line allowed to appear at a portion at which the flows of the melted resin merge into one in the mold to cause the welding or fusion during the injection molding. The weld line has a weak strength as compared with surrounding portions, and it is feared that any crack or the like may arise. The melted resin, which is injected into the mold, is gradually cooled, and the viscosity thereof is raised. Therefore, the parts of melted resin, which merge into one, are not sufficiently dissolved with each other at the merging portion of the flows. The parts of melted resin are solidified while causing the phase separation. This portion causes the weld line.

The flow of the rein in the mold will be explained with reference to FIG. 13 in relation to the case in which the housing of the connector formed with the through-holes is injection-molded. A receptacle connector 800 has a box-shaped housing 811. The housing 811 has a pair of lateral walls 812*a*, 812*b* which extend in parallel to each other, a pair of longitudinal walls 826*a* (only one of them is shown) which connect both end portions of the lateral walls 812*a*, 812*b* to each other, and a bottom plate 817. The bottom plate 817 extends to connect the pair of lateral walls 812*a*, 812*b* and the pair of longitudinal walls 826*a*. A plurality of through-holes

818, into which contact terminals 861 are forcibly inserted or pressed-in as described later on, are formed in one array along the lateral wall 812*a* through the bottom plate 817. Protrusions 819*a*, which are formed to interpose the pressed-in contact terminals 861 from the both sides, are provided between the plurality of through-holes 818 so that the protrusions 819*a* extend in the height direction of the lateral wall 812*a*.

When the housing 811 having the structure as described above is injection-molded, pins are arranged at portions corresponding to the through-holes 818 in the mold to prevent the inflow of the melted resin. A gate (not shown), from which the melted resin is introduced into the mold of the housing 811, is provided at a portion disposed in the upper-right direction in FIG. 13. The melted resin, which is injected into the mold, is allowed to flow in the direction directed from the right to the left of the housing 811 as viewed in FIG. 13. In this situation, the flow of the melted resin is once branched due to the presence of the pins, in the vicinity of the through-holes 818 at which the pins are arranged. The branched flows travel around the pins, and they merge into one again. The weld lines 830 appear at the merging portions of the resin. The weld lines arise in the vicinity of the through-holes 818 irrelevant to the position of the gate for introducing the melted resin, because the weld lines appear at the merging portions of the melted resin in the injection molding.

Further, as shown in FIG. 14, when the contact terminals 861 are pressed-in or forcibly inserted into the through-holes 818, the weld lines are stripped off upwardly due to the stress of the press-in. The enlarged or expanded weld lines become cracks 831. On the other hand, the high-function resin, which is excellent in the chemical resistance and the heat resistance, is used for the housing of the electrical connector. However, the molding is relatively difficult with the high-function resin, and the weld lines tend to appear with ease. For example, the liquid crystal resin (LCP) is excellent in the chemical resistance and the heat resistance. However, the liquid crystal resin (LCP) has the high orientation, and the melted resin of LCP is solidified in a short period of time. Therefore, the weld lines tend to appear with ease.

SUMMARY OF THE PRESENT APPLICATION

The Present Application has been made taking the foregoing circumstances into consideration, an object of which is to provide an electrical connector having such a structure that any crack does not appear even when contact terminals are pressed-in, by suppressing the appearance of weld lines in the vicinity of through-holes into which the contact terminals are pressed-in.

According to a first aspect of the Present Application, there is provided an electrical connector 3 including; a first connector 1 having a first housing 11, a second connector 2 which is mated with the first connector 1 to be electrically connected thereto, a plurality of first connector terminals 61*a* which are attached to the first housing 11, a plurality of through-holes 18*a* which are formed in the first housing 11 so as to be arranged in a predetermined direction and into which the first connector terminals 61*a* are inserted; and a recess 21 formed adjacently to the through-holes 18*a* in the first housing 11.

According to a second aspect of the Present Application, there is provided a connector 1 which is mated with another connector 2 to be electrically connected thereto, the connector 1 comprising: a housing 11, a plurality of connector terminals 61*a* which are attached to the housing 11, a plurality of through-holes 18*a* which are formed in the housing 11, so as to be arranged in a predetermined direction and into which the connector terminals 61*a* are inserted; and a recess 21 formed adjacently to the through-holes 18*a* in the housing 11.

In the housing of the electrical connector of the Present Application, the range of appearance of the weld lines is limited to the inside of the groove by forming the groove along the arrangement of the through-holes. The range of appearance of the weld lines is reduced as compared with any conventional housing. The weld lines are hardly conspicuous visually as well. As a result, the strength and the durability are improved in the vicinity of the through-holes, and the aesthetics is improved as well. Further, when the contacts (connector terminals) are pressed-in into the through-holes, the appearance of the crack, which would be otherwise caused by the weld line, can be suppressed. The Present Application is also effective when the functional resin such as the liquid crystal resin, with which the molding is difficult, is used.

BRIEF DESCRIPTION OF THE FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the illustrated embodiments, directional representations—i.e., up, down, left, right, front, rear and the like, used for explaining the structure and movement of the various elements of the Present Application, are relative. These representations are appropriate when the elements are in the position shown in the Figures. If the description of the position of the elements changes, however, it is assumed that these representations are to be changed accordingly.

Figure 1:
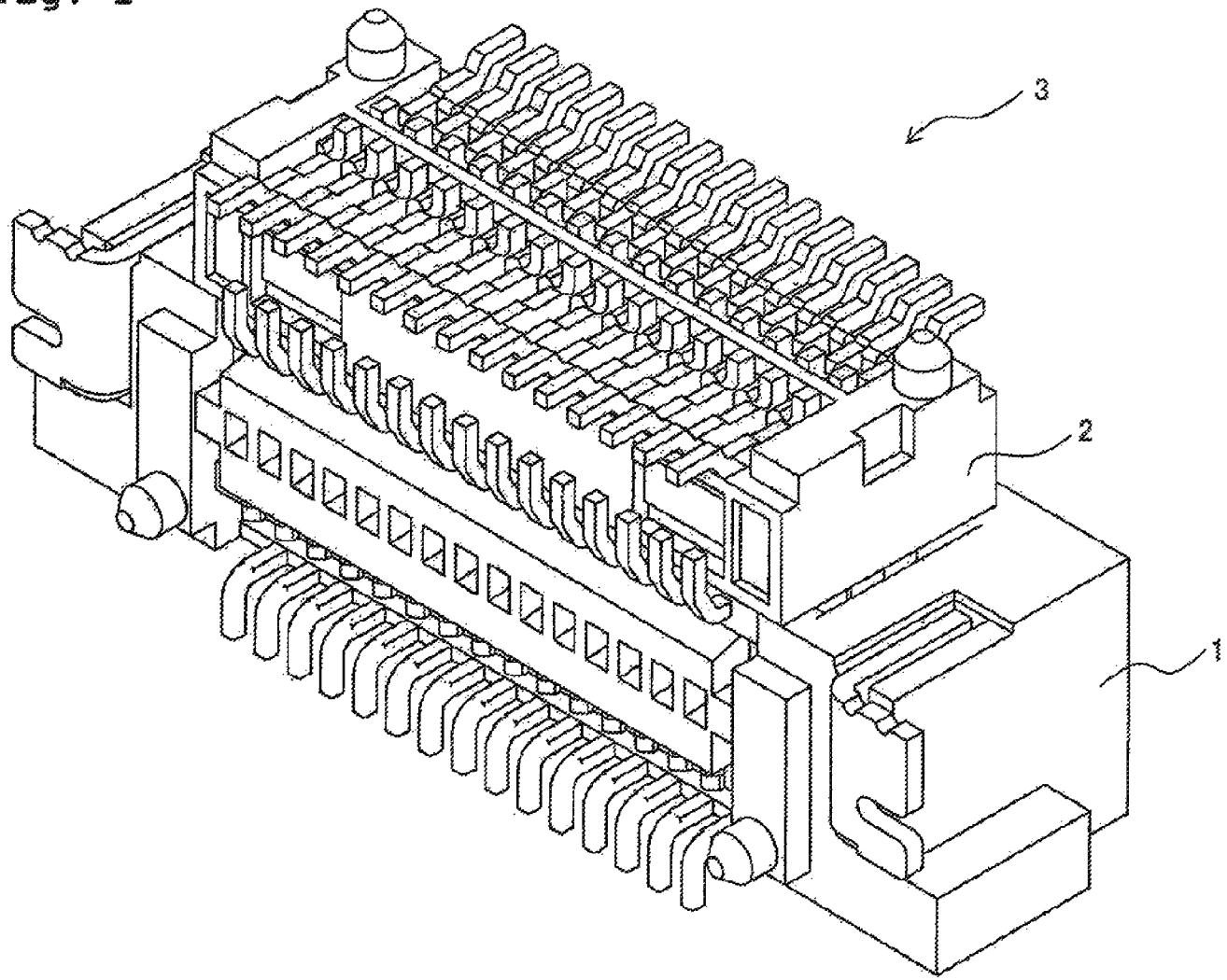
FIG. 1 shows a perspective view illustrating an electrical connector in which a receptacle connector and a plug connector are mated together, viewed from the side of the plug connector.

As shown in FIG. 1, an electrical connector according the Present Application resides in a pair of board-to-board connectors 3 (electrical connector) composed of a receptacle connector 1 and a plug connector 2. The board-to-board connector 3 electrically connects the boards to which the receptacle connector 1 and the plug connector 2 are attached respectively, by the connection between the receptacle connector 1 and the plug connector 2.

Figure 12:
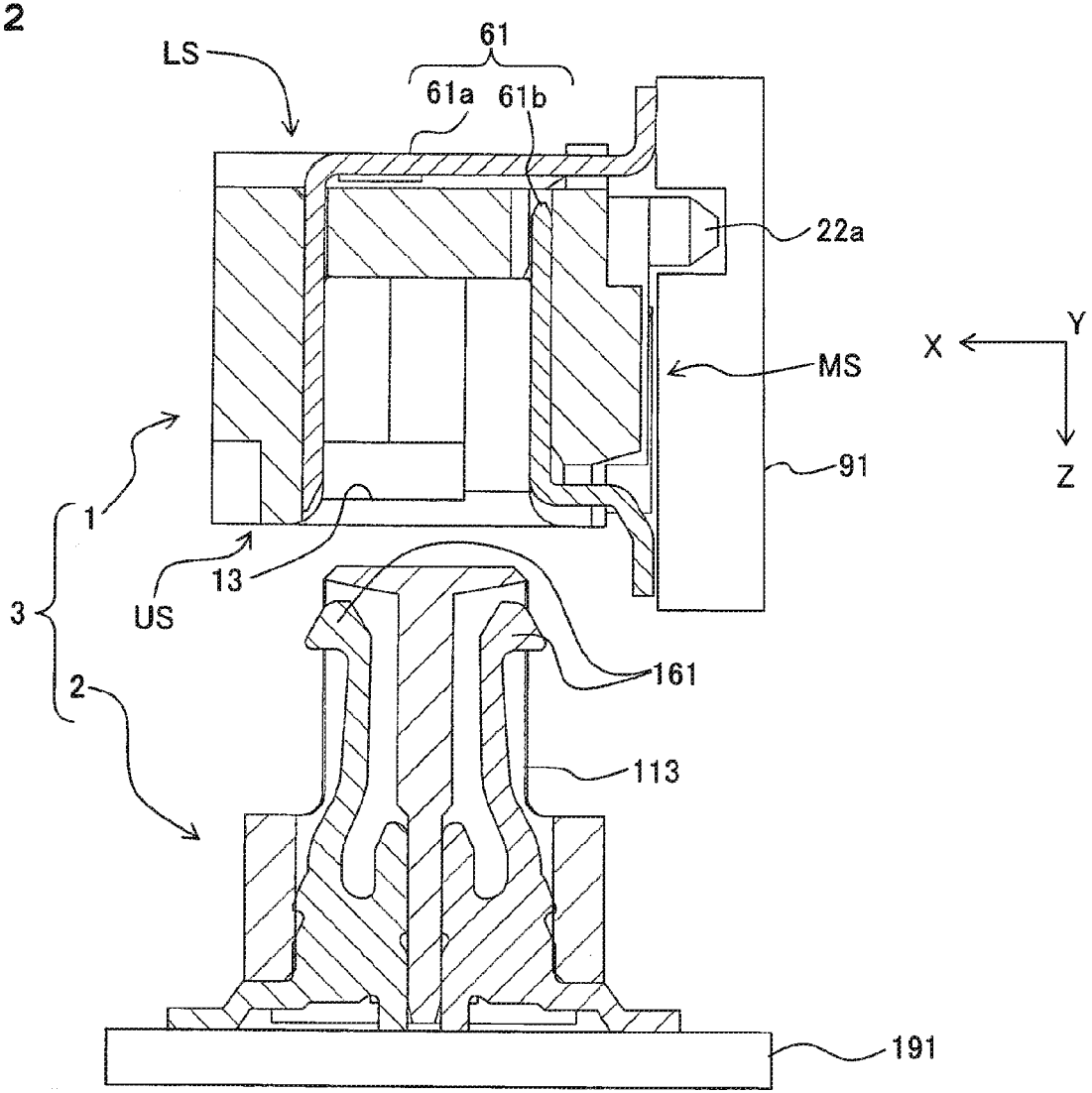
FIG. 12 shows a sectional view illustrating the receptacle connector and the plug connector of the Present Application.

The receptacle connector 1 will be explained with reference to FIGS. 2 and 12. The receptacle connector 1 is a member which has a rectangular prism-shaped (rectangular parallelepiped) contour. The receptacle connector 1 is mounted on the board 91 by soldering receptacle contacts or contact terminals 61 to the board 91 as described later on. In this specification, the side of the receptacle connector, on which the receptacle connector is mated to the plug connector 2, is appropriately referred to as "mounting side" or "upper side", and the side, which is opposite to the mating side, is appropriately referred to as "lower side". Further, the side of the plug connector 1, on which the plug connector 1 is mounted on the board, is referred to as "mounting side". In FIG. 12, the upper side (mating side), the lower side, and the mounting side are indicated by symbols "US", "LS", and "MS" respectively. As appreciated from FIG. 12, the surfaces on the upper side (mating side) and the lower side are perpendicular to the surface on the mounting side in the receptacle connector 1 of the Present Application. However, the surface on the mounting side may be formed on the surface on the lower side. In this specification, the direction (direction indicated as "Y" in FIG. 2), in which the rectangular prism-shaped receptacle connector 1 extends, is appropriately referred to as "longitudinal direction", the direction (direction indicated as "X" in FIG. 2), which is perpendicular to the "longitudinal direction" in the plane parallel to the board 91, is appropriately referred to as "transverse direction", and the direction (direction indicated as "Z" in FIG. 2), which is perpendicular to the longitudinal direction and the transverse direction, is appropriately referred to as "height direction".

The receptacle connector 1 has a box-shaped housing 11, the plurality of receptacle contacts 61 which are installed to the housing 11, and a pair of receptacle reinforcing fixtures 51 which are installed to the housing 11 from the mating side. The receptacle contacts include two types of contacts, i.e., first receptacle contacts 61*a* and second receptacle contacts 61*b*.

At first, the housing 11 of the receptacle connector 1 will be explained with reference to FIGS. 2 to 6. The housing 11 has a pair of lateral walls 12*a*, 12*b* which extend in parallel to each other in the longitudinal direction, a pair of longitudinal walls 26*a*, 26*b* which extend in the transverse direction to connect both end portions of the lateral walls 12*a*, 12*b* to each other, and a bottom plate 17. The bottom plate 17 extends on the lower side of the housing 11 to connect the lateral wall 12*a* and the lateral wall 12*b* and connect the longitudinal wall 26*a* and the longitudinal wall 26*b*. A space 13 is defined at a central portion of the housing 11 by the lateral walls 12*a*, 12*b*, the longitudinal walls 26*a*, 26*b*, and the bottom plate 17. A part of the plug connector 2 is inserted into the space 13 as described later on. Grooves 23*a*, 23*b*, to which the receptacle reinforcing fixtures 51 are attached respectively, are formed on the upper surfaces 26Ua, 26Ub of the longitudinal walls. Each of the grooves 23*a*, 23*b* is open on one side surface 26Sa, 26Sb of the longitudinal wall. The receptacle reinforcing fixture 51 is a fixture (metallic fixture) to strengthen or reinforce the coupling or engagement between the housing 11 and the board 91.

Figure 5:
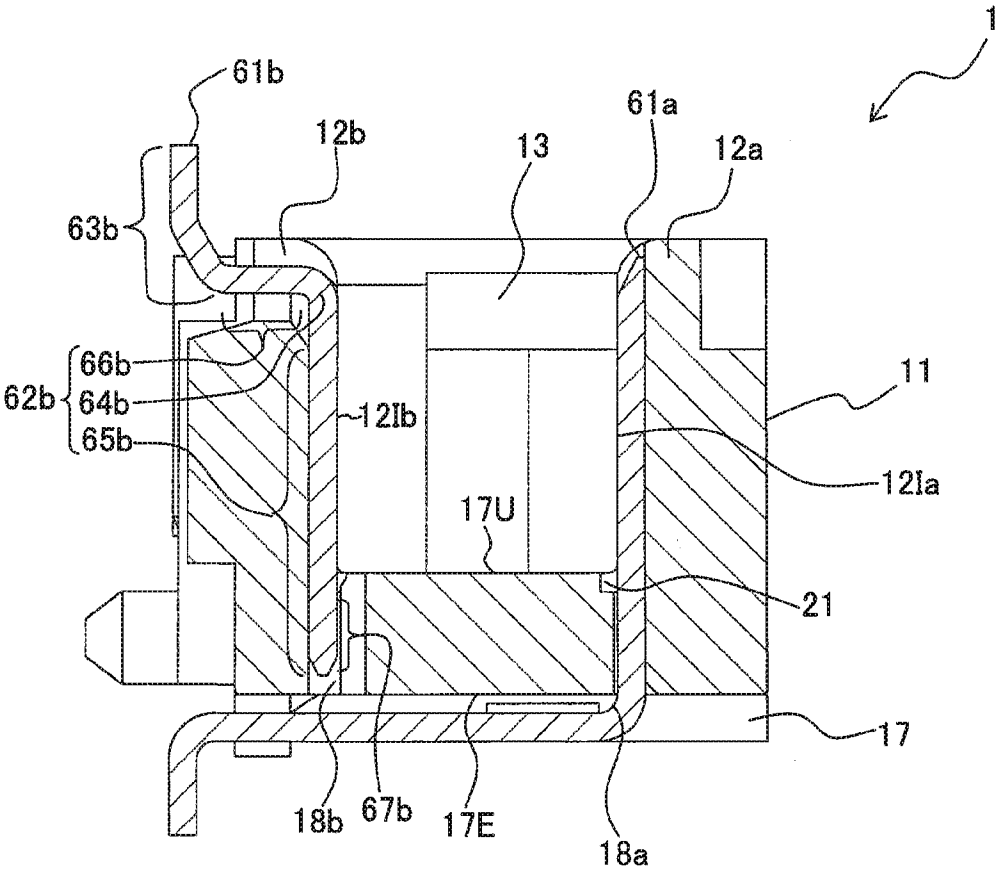
FIG. 5 shows a sectional view illustrating the receptacle connector of FIG. 1.
Figure 6:
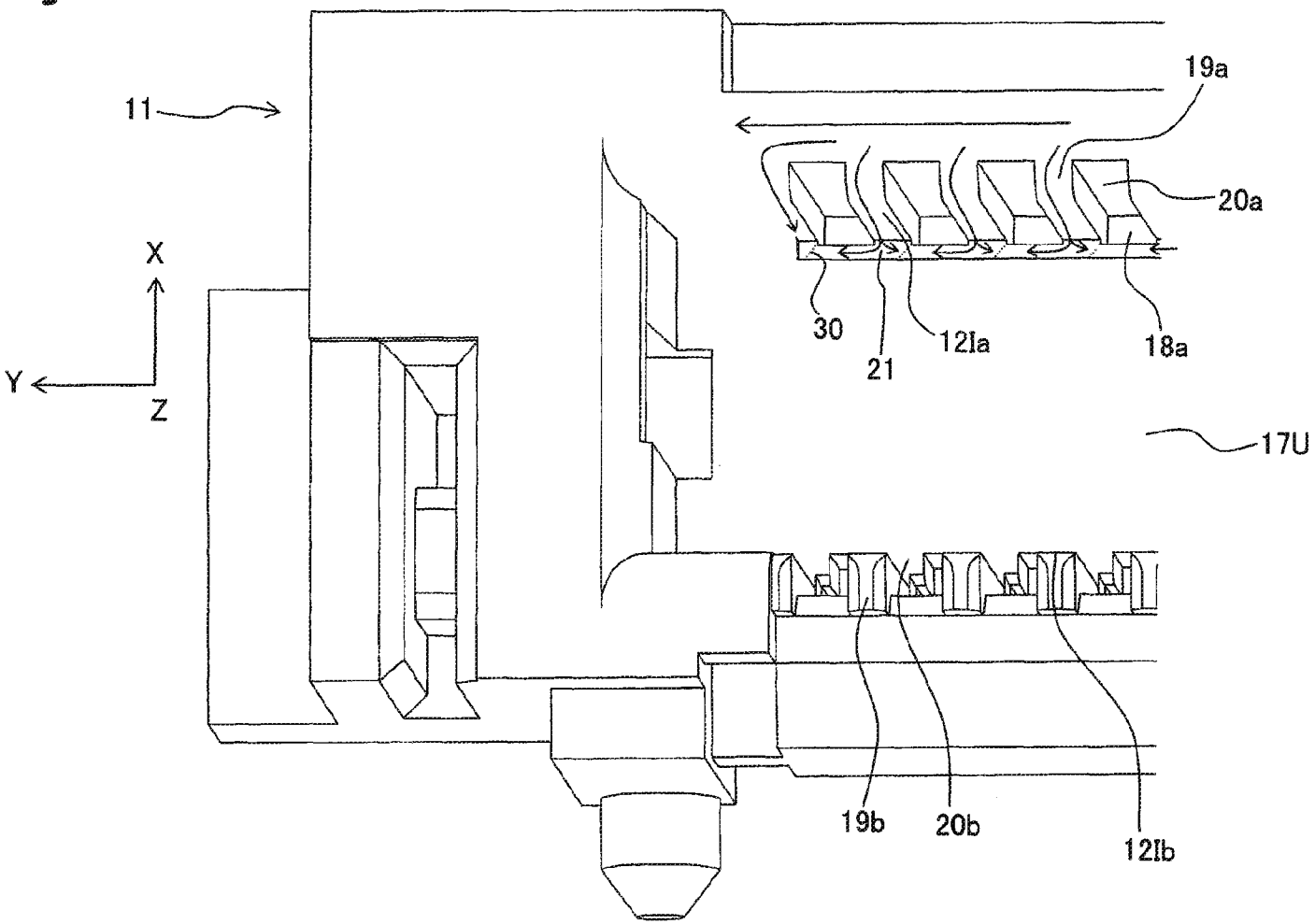
FIG. 6 shows a view illustrating the receptacle connector of FIG. 1, viewed from the mating side with respect to the plug connector, which is a magnified view illustrating those disposed in the vicinity of through-holes 18*a* and a lateral groove 21.

As shown in FIGS. 5 and 6, a plurality of through-holes 18*a*, into which the first receptacle contacts 61*a* are inserted, are formed through the bottom plate 17. At first, a plurality of longitudinal grooves 20*a*, which extend in the height direction, are formed while being separated from each other by predetermined spacing distances on the inner surface 121*a*. A plurality of protrusions 19*a*, which extend in the height direction, are formed between the adjoining longitudinal grooves 20*a*. In other words, the longitudinal grooves 20*a* and the protrusions 19*a* are alternately disposed in the longitudinal direction. Further, the longitudinal grooves 20*a* penetrate through the bottom plate 17 to thereby define the through-holes 18*a*. The longitudinal grooves 20*a* and the through-holes 18*a* are continuously provided in the height direction. In other words, the through-holes 18*a* and the protrusions 19*a* are alternately disposed in the longitudinal direction. A lateral groove (recess) 21, which has a predetermined depth in the direction directed from the upper surface 17U toward the lower surface 17E of the bottom surface 17, is formed on the upper surface 17U (surface to compart the space 13) of the bottom plate 17. The lateral groove 21 is formed to extend in the direction of arrangement of the through-holes 18*a* so that the lateral groove 21 is disposed adjacently to the through-holes 18*a* and the protrusions 19*a*. The first receptacle contacts 61*a* are inserted into the longitudinal grooves 20*a*. The through-holes 18*a* interpose and hold the first receptacle contacts 61*a*. The cross section of the lateral groove 21 is rectangular.

Further, a plurality of through-holes 18*b*, into which the second receptacle contacts 61*b* are inserted, are formed through the bottom plate 17 while being arranged in the longitudinal direction. The through-holes 18*b* are arranged adjacently to the inner surface 12Ib (surface to define the space 13) of the lateral wall 12*b*. A plurality of longitudinal grooves 20*b*, which extend in the height direction, are formed while being separated from each other by predetermined spacing distances on the inner surface 12*Ib*. A plurality of protrusions 19*b*, which extend in the height direction, are formed between the adjoining longitudinal grooves 20*b*. The second receptacle contacts 61*b* are inserted into the longitudinal grooves 20*b*. The plurality of protrusions 19*b* interpose and hold the second receptacle contacts 61*b*. The longitudinal grooves 20*b* penetrate through the bottom plate 17 to thereby define the through-holes 18*b* into which the forward ends of the second receptacle contacts 61*b* are inserted.

Figure 2:
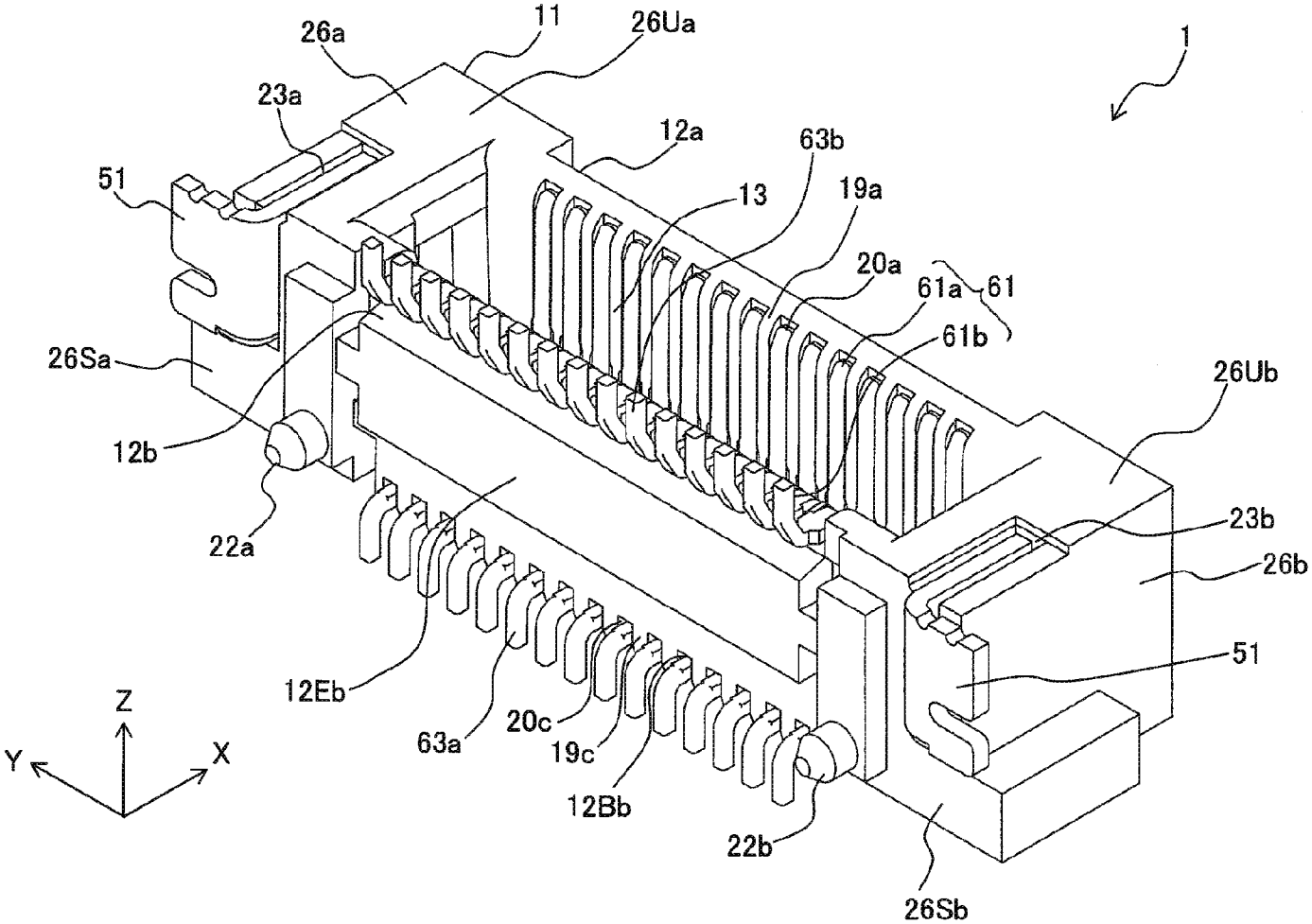
FIG. 2 shows a perspective view illustrating the receptacle connector of FIG. 1, viewed from the side of a surface on which the receptacle connector is mounted on a board and the mating side with respect to the plug connector.
Figure 4:
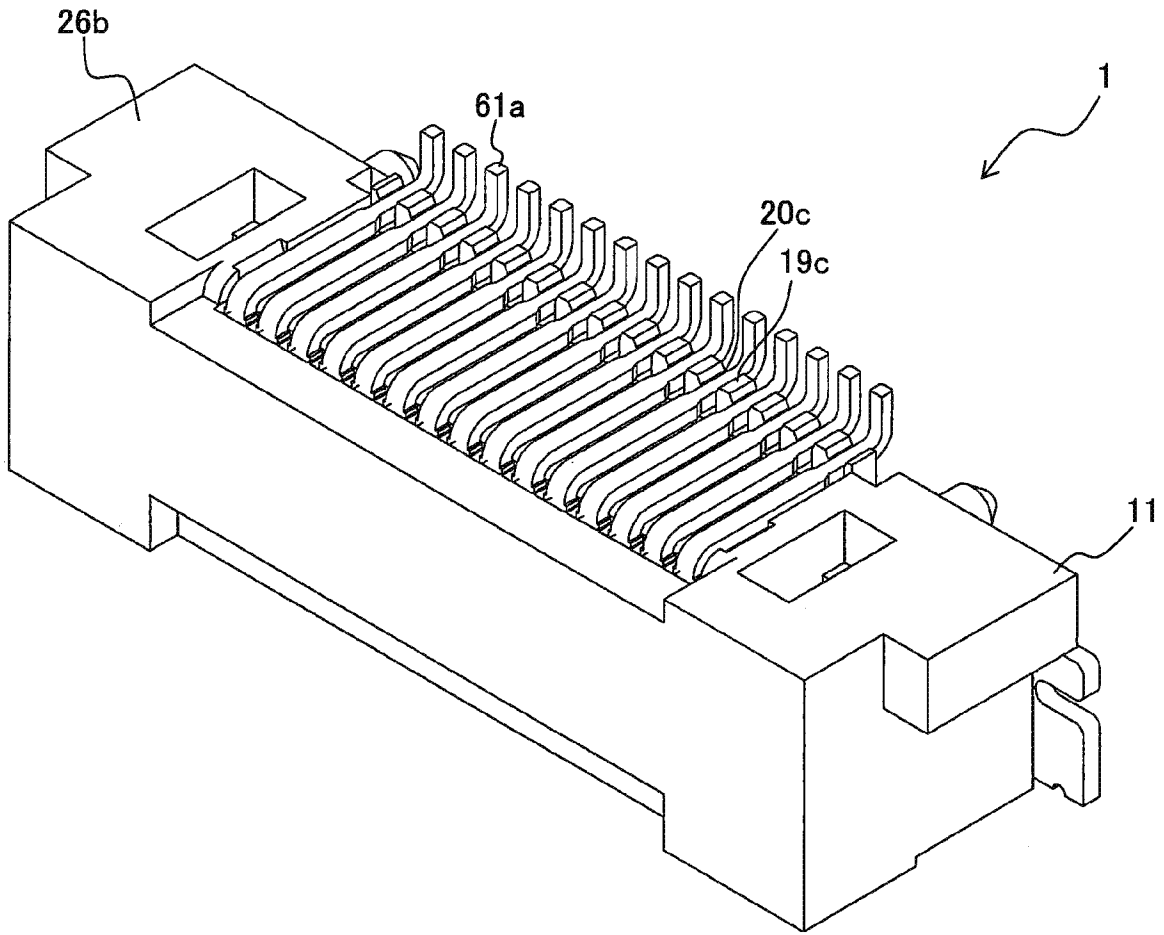
FIG. 4 shows a perspective view illustrating the receptacle connector of FIG. 1, viewed from the side opposite to the surface on which the receptacle connector is mounted on the board and the side opposite to the mating side with respect to the plug connector.

As shown in FIGS. 2 and 4, a plurality of protrusions 19*c*, which are formed to interpose and hold the first receptacle contacts 61*a*, are provided on the lower surface 12Bb of the lateral wall 12*b*. Recesses 20*c*, into which the first receptacle contacts 61*a* are inserted, are formed between the adjoining protrusions 19*c*.

Protruding portions 22*a*, 22*b* are provided on the side surfaces 26Sa, 26Sb of the longitudinal walls. Recesses, in which the protruding portions 22*a*, 22*b* are accommodated, are formed for the board 91. When the protruding portions 22*a*, 22*b* are inserted into the recesses of the board 91, the receptacle connector 1 can be easily mounted on the board 91. The receptacle connector 1 is not moved as well when the receptacle connector 1 is soldered to the board 91. The receptacle connector 1 can be soldered at the correct position. Here, the two protruding portions 22*a*, 22*b* are provided. However, any number of the protruding portion or the protruding portions may be provided. On the contrary, it is also allowable to provide no protruding portion. The design can be appropriately changed. The outer surface 12Eb (surface disposed on the side opposite to the inner surface 12*Ib*) of the lateral wall 12*b* and the side surfaces 26Sa, 26Sb of the longitudinal walls are the surfaces to perform the mounting on the board 91.

An explanation will be made below about an actual method for producing the receptacle connector having the structure as described above. The housing 11 of the receptacle connector 1 was molded by the injection molding. A cavity, which corresponded to the contour or outer shape of the housing 11, was formed by an upper mold and a lower mold. Pins were arranged at corresponding positions in the cavity in order to prevent the melted resin from entering the through-holes 18*a*, 18*b*. A gate 40, from which the melted resin was introduced into the cavity, was provided at the corresponding position in the mold (see FIG. 3). The thermoplastic resin, which was plasticized and melted, was injected into the cavity from the gate 40. The resin, which was injected into the cavity, was allowed to flow in the direction directed from the right to the left of the housing 11 as shown in FIG. 6, and the interior of the cavity was filled with the resin. After solidifying the charged resin, the upper mold and the lower mold were separated from each other to take out the housing 11 as the molded product.

Figure 13:
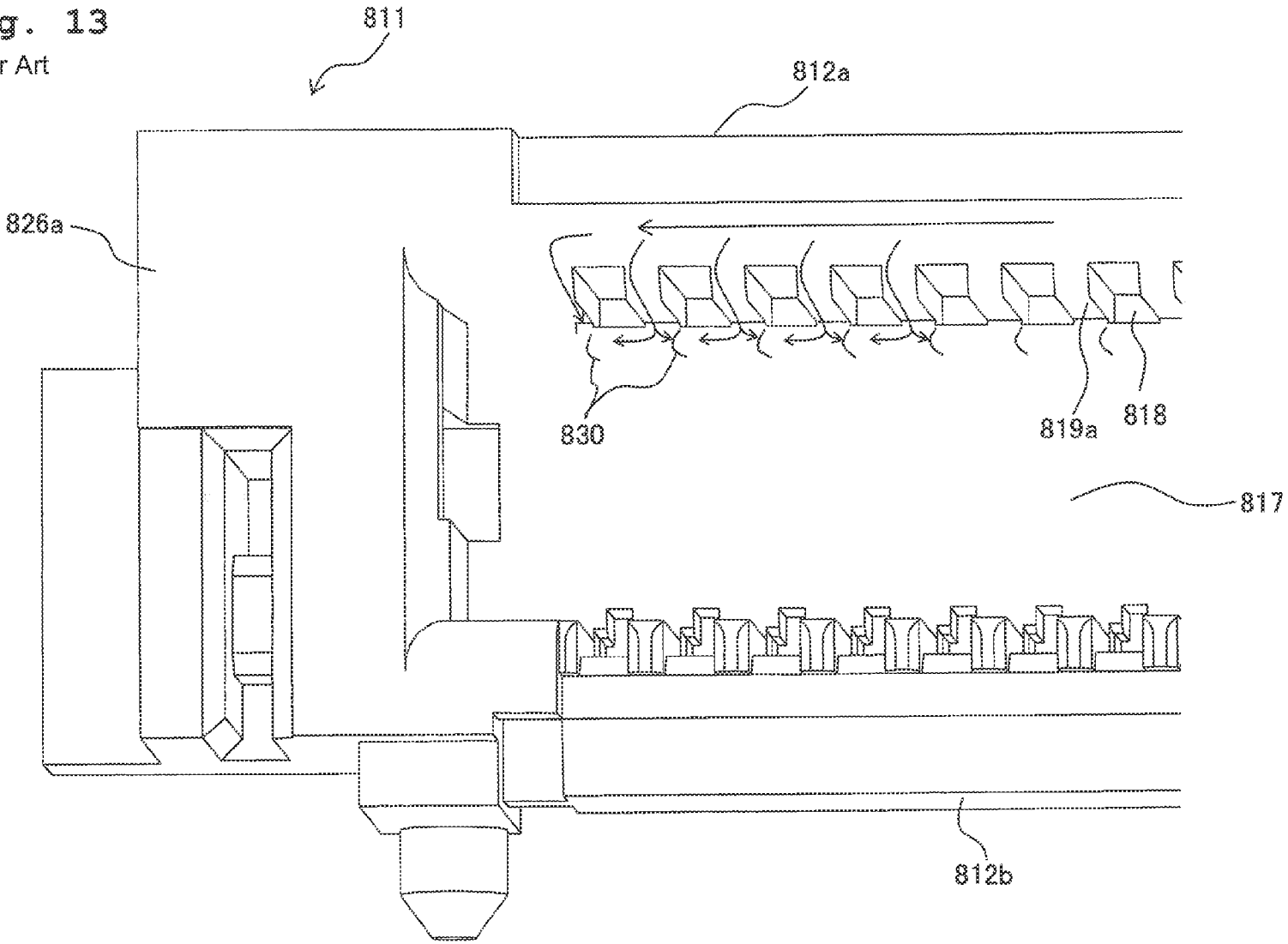
Fig. 13 Prior Art
FIG. 13 shows a view illustrating a housing of a conventional receptacle connector from the mating side with respect to a plug connector, which is a magnified view illustrating those disposed in the vicinity of through-holes 818.

In the injection molding of the housing 11, the flow of the melted resin is once branched due to the presence of the pin in the vicinity of the through-hole 18*a* at which the pin is arranged. When the branched flows travel around the pin, the branched flows merge into one again. The weld line 30 appears at the merging portion of the resin. However, the lateral groove 21 is provided. Therefore, it is considered that the weld line 30 appears in only the interior of the lateral groove 21, and the weld line 30 is not spread beyond the lateral groove 21. Therefore, the range, in which the weld lines 30 appear, is reduced as compared with the conventional weld lines 830 shown in FIG. 13. Owing to the fact that the range of appearance of the weld lines can be restricted within the lateral groove 21, the strength of the housing 11 is improved in the vicinity of the through-holes 18, and the risk of the appearance of crack is lowered.

Figure 7:
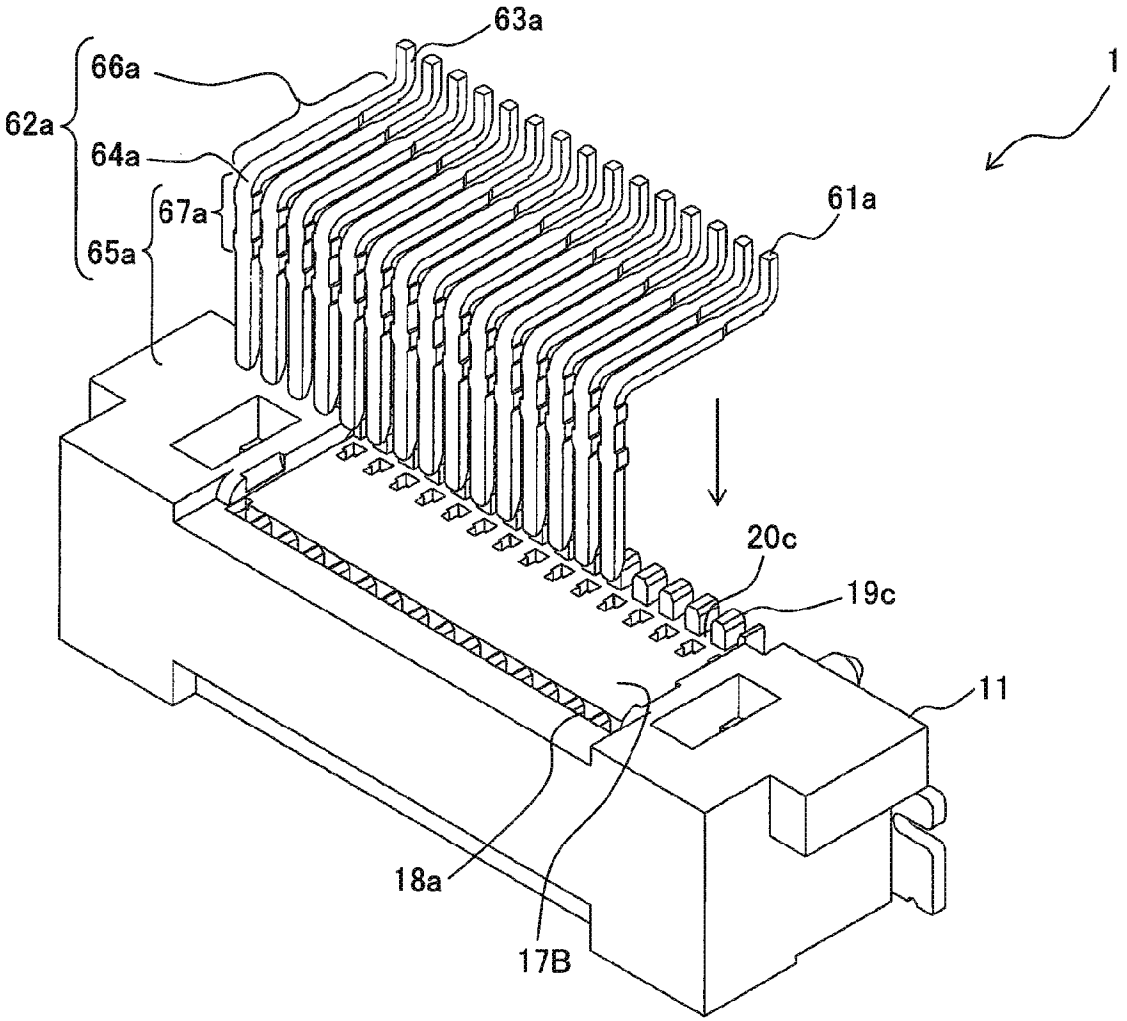
FIG. 7 shows an exploded view illustrating the receptacle connector of FIG. 1, viewed from the side opposite to the surface on which the receptacle connector is mounted on the board and the side opposite to the mating side with respect to the plug connector.

At first, the first receptacle contacts 61*a* will be explained. As shown in FIG. 7, the first receptacle contact 61*a* is a bent rod-shaped metal member which is composed of a substantially L-shaped main body 62*a* and a tail 63*a*. The main body 62*a* is composed of an insertion portion 65*a* and a connecting portion 66*a* which extend in mutually perpendicular directions with a bent portion 64*a* intervening therebetween. A fixing portion 67*a*, which is formed with wedge-shaped projections and recesses (convex and concave) on the side surfaces, is provided at the insertion portion 65*a* in the vicinity of the bent portion 64*a*. The tail 63*a* extends while being bent in the direction opposite to the extending direction of the insertion portion 65*a* from the end of the connecting portion 66*a*.

Figure 8:
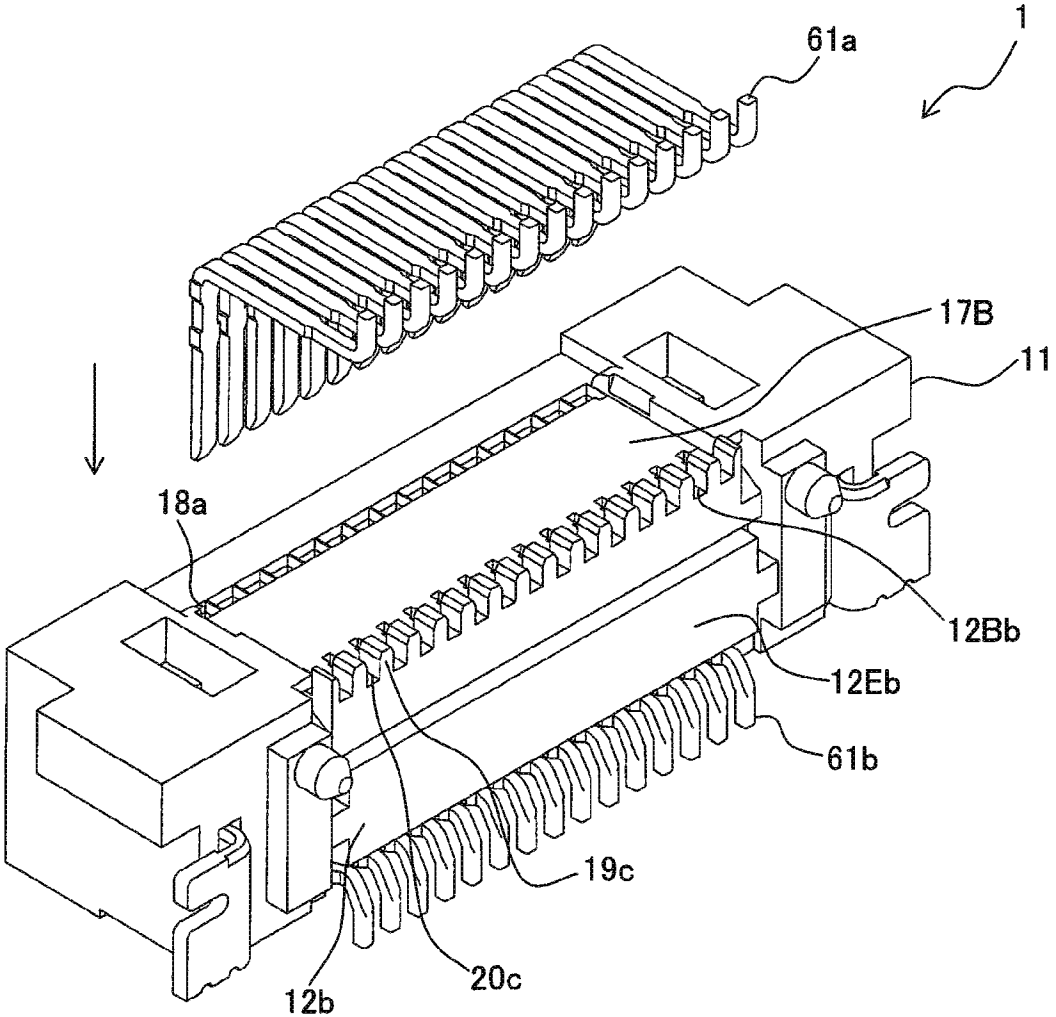
FIG. 8 shows an exploded view illustrating the receptacle connector of FIG. 1, viewed from the side of the surface on which the receptacle connector is mounted on the board and the side opposite to the mating side with respect to the plug connector.

An explanation will be made with reference to FIGS. 7 and 8 about the installation of the first receptacle contacts 61*a* to the receptacle connector 1. The tails 63*a* are directed toward the mounting side of the receptacle connector 1, and the forward ends of the insertion portions 65*a* are positionally adjusted so that the forward ends of the insertion portions 65*a* are opposed to the through-holes 18*a* from the lower side of the receptacle connector 1. The first receptacle contacts 61*a* are pressed from the lower side of the receptacle connector 1, and the first receptacle contacts 61*a* are pressed-in or forcibly inserted into the through-holes 18*a* until arrival of the bent portions 64*a*. As a result, the fixing portions 67*a* bite into the inner walls of the bottom plate 17 for defining the through-holes 18*a*, and the first receptacle contacts 61*a* are installed or attached to the receptacle connector 1. In this situation, the portions of the connecting portions 66*a*, which are disposed in the vicinity of the tails, are inserted into the recesses 20*c*, and they are retained by the protrusions 19*c* from the both sides. As shown in FIG. 2, the insertion portions 65*a*, which are exposed to the interior of the space 13 while penetrating through the through-holes 18, are inserted into the longitudinal grooves 20*a* provided on the inner surface 12Ib of the lateral wall.

Figure 14:
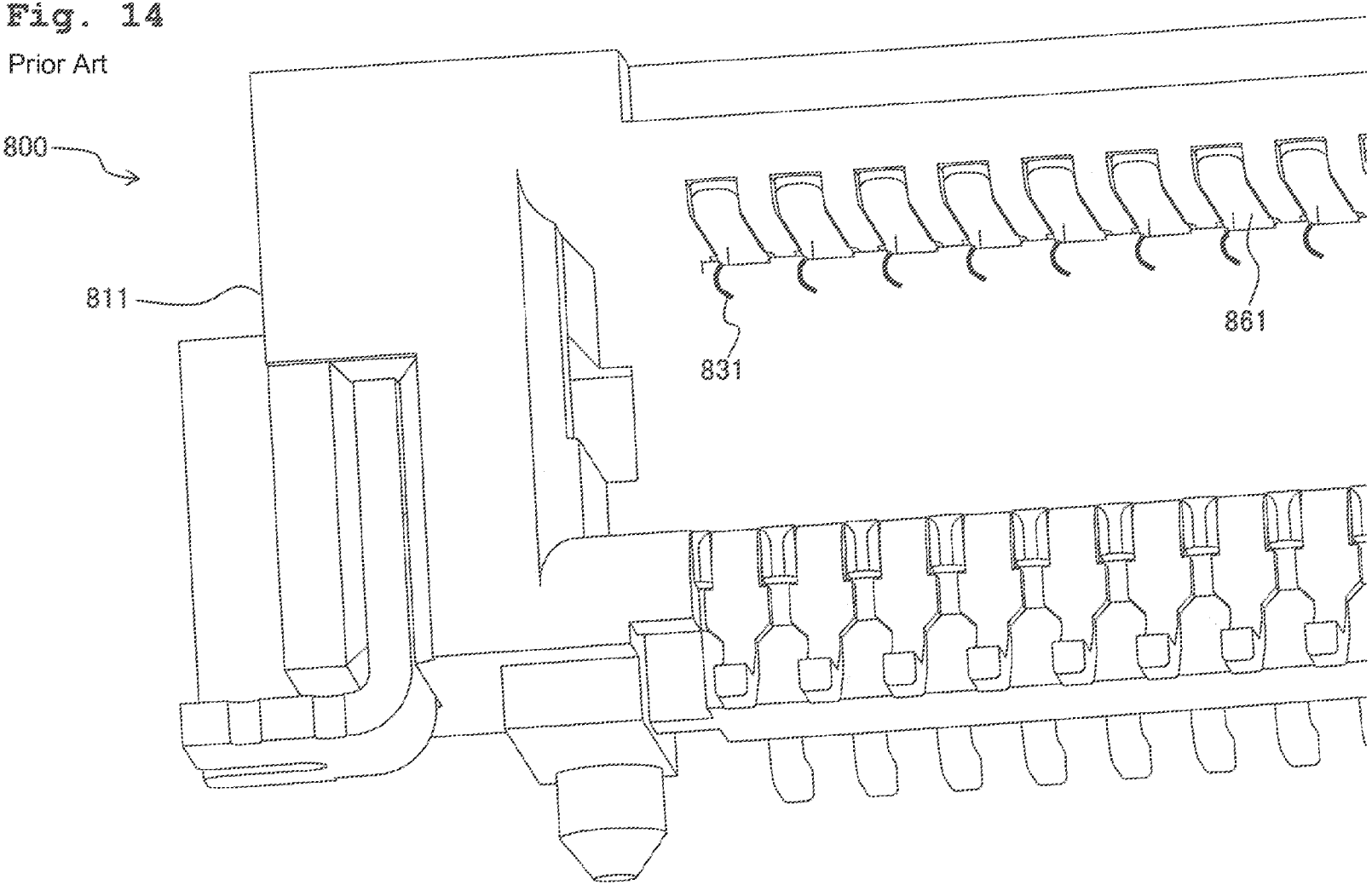
Fig. 14 Prior Art
FIG. 14 shows a view illustrating the conventional receptacle connector from the mating side with respect to the plug connector, which is a magnified view illustrating those disposed in the vicinity of the through-holes 818.

When the first receptacle contact 61*a* is pressed-in into the through-hole 18*a*, and the fixing portion 67*a* bites into the housing 11, then the stress is applied to the housing 11. On account of this stress, the force, which intends to forcibly widen or spread the weld line 30, acts on the housing 11. However, the weld line 30 is not spread to the outside of the lateral groove 21 even after the first receptacle contact 61*a* is pressed-in. In other words, the occurrence of the crack 831 shown in FIG. 14, which has been caused in the housing of the conventional connector, is avoided. The strength, the durability, and the dimensional accuracy are improved in the receptacle connector 1 as compared with the conventional connector, because no crack appears in the housing 11.

Figure 3:
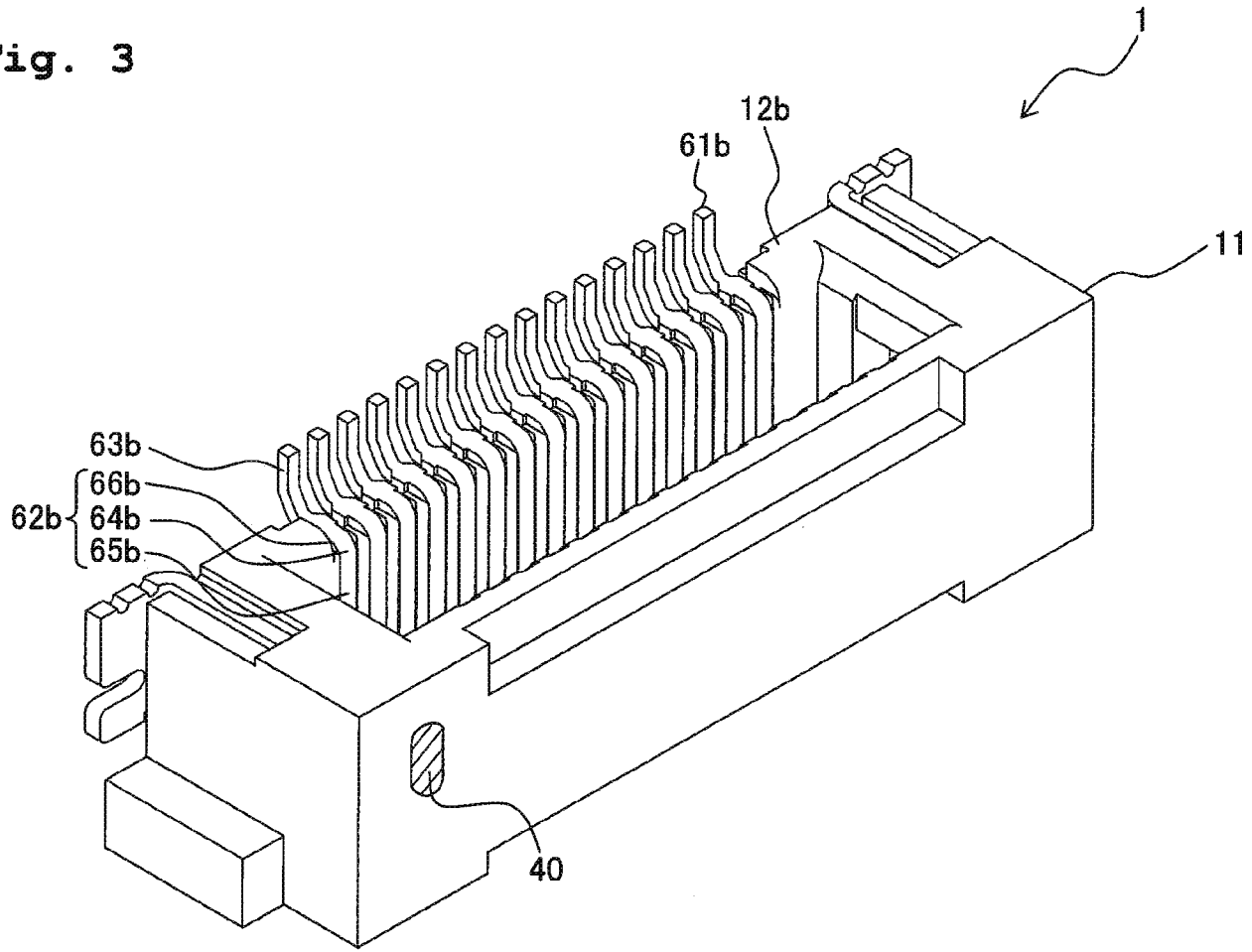
FIG. 3 shows a perspective view illustrating the receptacle connector of FIG. 1, viewed from the side opposite to the surface on which the receptacle connector is mounted on the board and the mating side with respect to the plug connector.

Next, the second receptacle contacts 61*b* will be explained with reference to FIGS. 3 and 5. The second receptacle contact 61*b* is a bent rod-shaped metal member which is composed of a substantially L-shaped main body 62*b* and a tail 63*b*. The main body 62*b* is composed of an insertion portion 65*b* and a connecting portion 66*b* which extend in mutually perpendicular directions with a bent portion 64*b* intervening therebetween. The insertion portion 65*b* is longer than the connecting portion 66*b*. The main body 62*b* has a deformed L-shaped form. A fixing portion 67*b*, which has wedge-shaped projections and recesses (convex and concave) formed on the side surfaces, is provided in the vicinity of the forward end of the insertion portion 65*b*. The tail 63*b* extends while being bent in the direction opposite to the extending direction of the insertion portion 65*b* from the end of the connecting portion 66*b*.

An explanation will be made with reference to FIGS. 3, 5, and 6 about the installation of the second receptacle contacts 61*b* to the receptacle connector 1. The tails 63*b* are directed toward the mounting side of the receptacle connector 1, and the forward ends of the insertion portions 65*b* are positionally adjusted so that the forward ends of the insertion portions 65*b* are opposed to the through-holes 18*b* from the upper side of the receptacle connector 1. When the second receptacle contacts 61*b* are pressed from the upper side of the receptacle connector 1, then the insertion portions 65*b* are inserted into the longitudinal grooves 20*b*, and the fixing portions 67*b*, which are provided in the vicinity of the forward ends thereof, are pressed-in into the through-holes 18*b*. As a result, the fixing portions 67*b* bite into the inner walls of the bottom plate 17 for defining the through-holes 18*b*, and the second receptacle contacts 61*b* are installed or attached to the receptacle connector 1. As shown in FIG. 5, the forward ends of the insertion portions 65*b*, which are inserted into the through-holes 18*b*, do not penetrate through the bottom plate 17, and they stay in the bottom plate 17.

As shown in FIGS. 2 and 5, the first receptacle contacts 61*a* and the second receptacle contacts 61*b*, which are installed to the receptacle connector 1, have the tails 63*a*, 63*b* which are exposed on the outer surface 12Eb of the lateral wall, i.e., the mounting surface of the receptacle connector 1. The tails 63*a*, 63*b* are soldered to the board 91 to connect the board 91 and the receptacle connector 1 electrically and physically.

Figure 9:
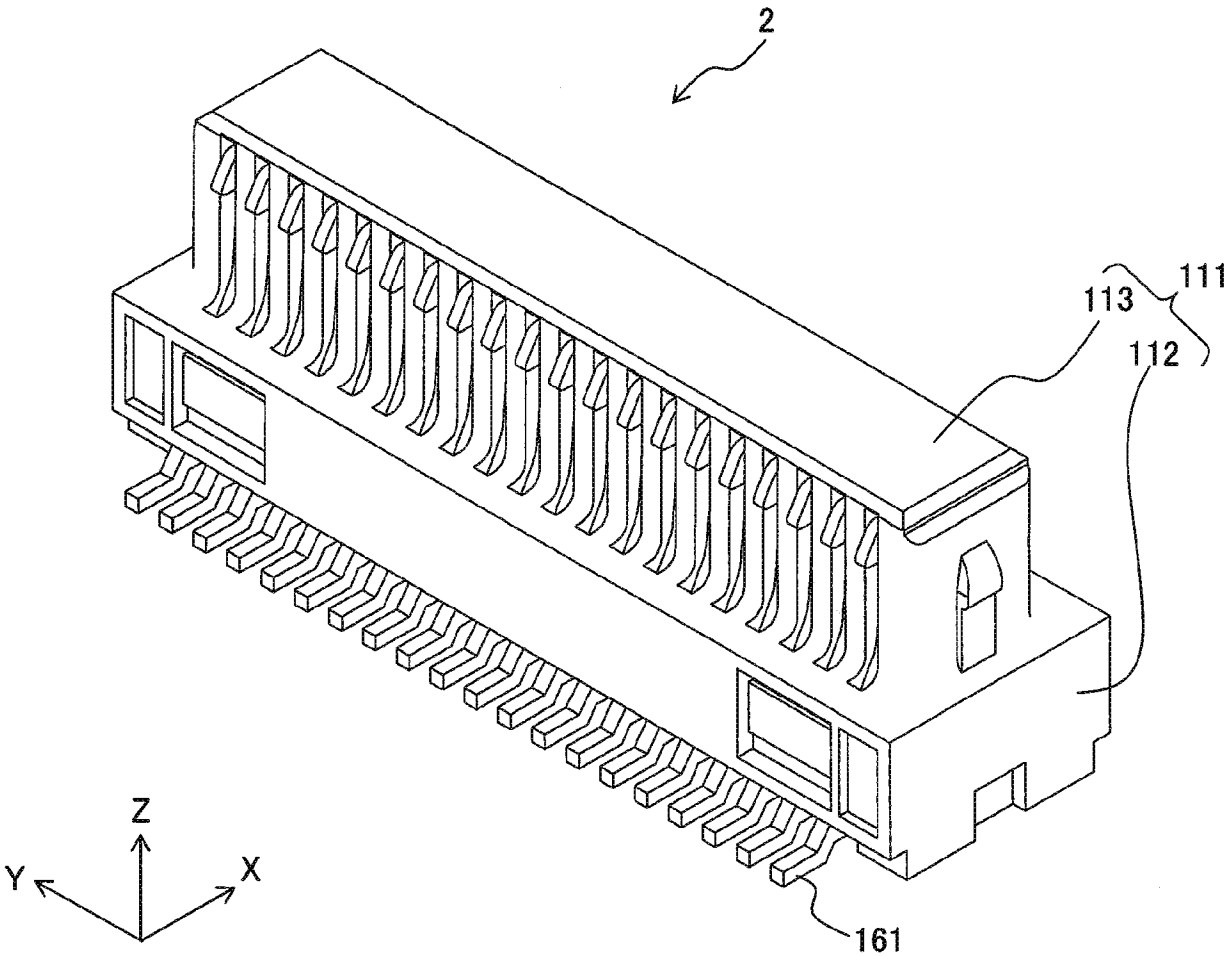
FIG. 9 shows a perspective view illustrating the plug connector of FIG. 1, viewed from the mating side with respect to the receptacle connector.
Figure 10:
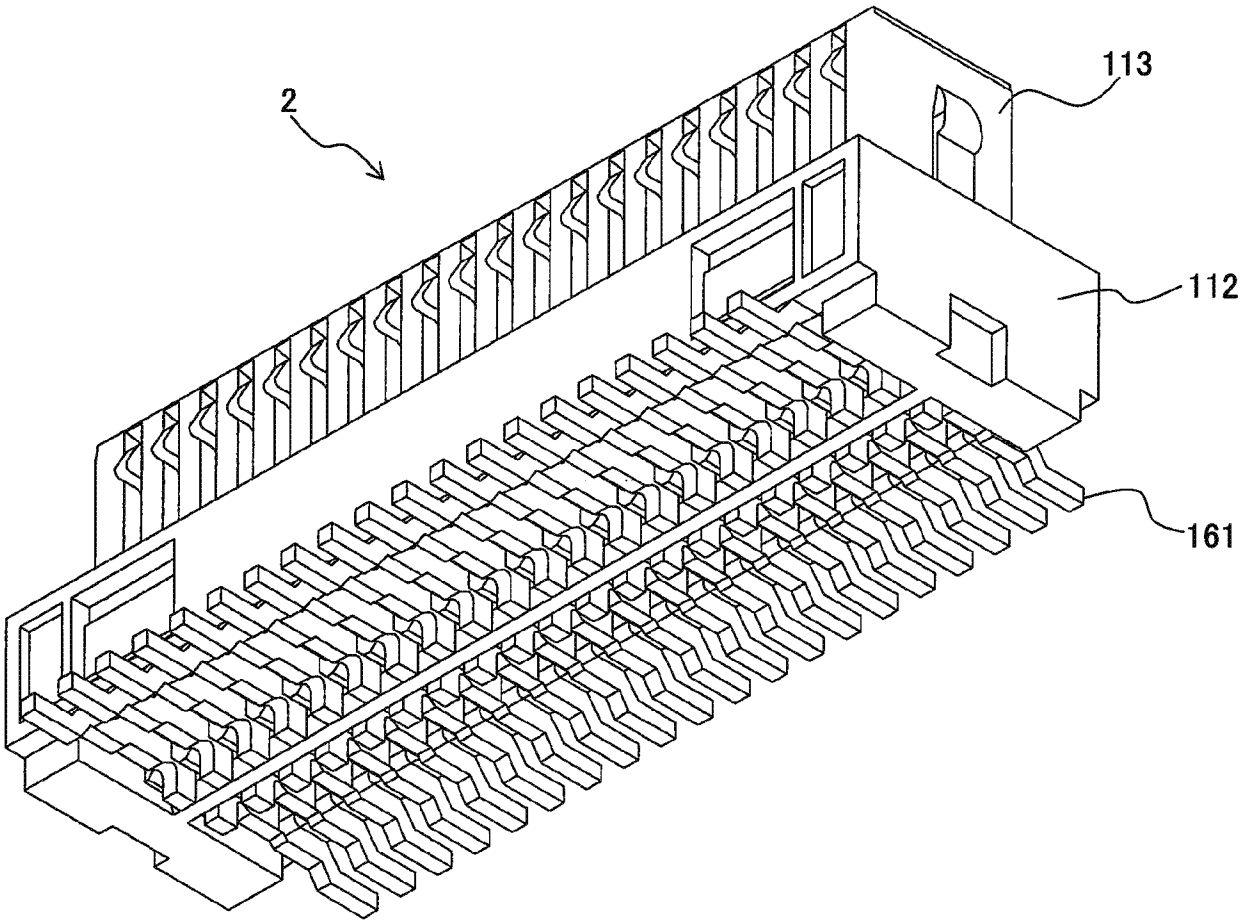
FIG. 10 shows a perspective view illustrating the plug connector of FIG. 1, viewed from the mounting side on which the plug connector is mounted on the board.

The plug connector 2 will be explained with reference to FIGS. 9 to 11. The plug connector 2 is a member which has such a contour that a smaller rectangular prism-shaped (rectangular parallelepiped) insertion portion 113 protrudes from a surface of a rectangular prism-shaped (rectangular parallelepiped) base 112. The plug connector 2 is mounted on the board 191 by soldering plug contacts or contact terminals (plug connector terminals) 161 to the board 191 (see FIG. 12). In this specification, the side of the plug connector 2, on which the plug connector 2 is mounted on the board, is appropriately referred to as "mounting side" or "lower side", and the side, on which the receptacle connector 1 is coupled or fitted, is appropriately referred to as "mating side" or "upper side". In this specification, the direction (direction indicated as "Y" in FIG. 9), in which the rectangular prism-shaped plug connector 2 extends, is appropriately referred to as "longitudinal direction", the direction (direction indicated as "X" in FIG. 9), which is perpendicular to the "longitudinal direction" in the plane parallel to the board 191, is appropriately referred to as "transverse direction", and the direction (direction indicated as "Z" in FIG. 9), which is perpendicular to the plane of the board 191, is appropriately referred to as "height direction".

The plug connector 2 has a housing 111, and the plurality of plug contacts 161 which are installed or attached to the housing 111 from the lower side. The housing 111 is composed of the rectangular prism-shaped base 112, and the rectangular prism-shaped insertion portion 113 which is provided to protrude from the surface of the base 112. The insertion portion 113 is the rectangular prism which is smaller than the base 112 in the longitudinal direction and the transverse direction. When the receptacle connector 1 and the plug connector 2 are fitted or mated to each other, the insertion portion 113 is inserted into the space 13 of the receptacle connector 1.

Figure 11:
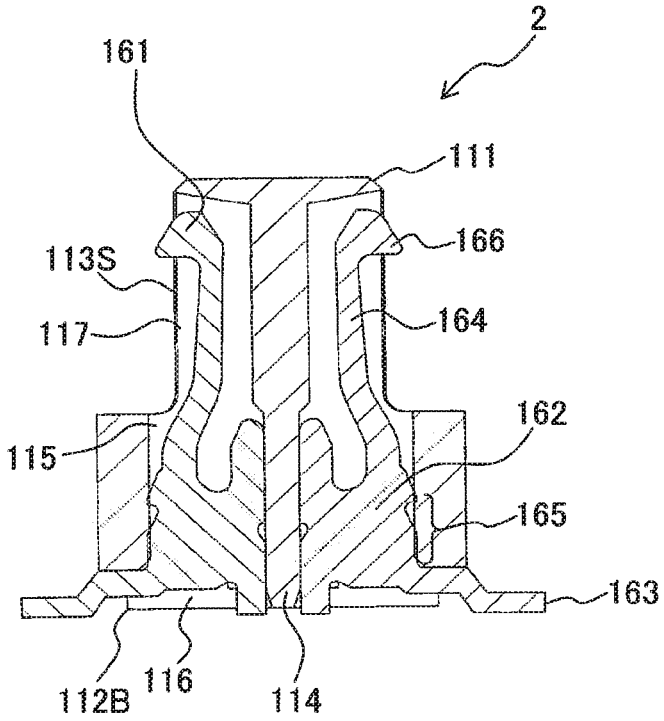
FIG. 11 shows a sectional view illustrating the plug connector of FIG. 1.

As shown in FIG. 11, a plurality of spaces 115, which accommodate the plug contacts 161, are formed on the both sides while interposing a central wall 114 which extends in the longitudinal direction, in the housing 111. The spaces 115 are open as openings 116 on the lower surface 112B of the base portion, and the spaces 115 are open as slits 117 on the both side surfaces 1135 of the insertion portion 113. Parts of the plug contacts 116 accommodated in the spaces 115 protrude to the outside of the housing 111 from the openings 116 and the slits 117.

The plug contact 161 is a member formed by stamping a conductive metal plate. The plug contact 161 has a main body 162, a tail 163 which extends from the main body 162, and an arm 164 which extends from the main body 162 in the direction substantially perpendicular to the extending direction of the tail 163. A fixing portion 165, which avoids the disengagement from the housing 111, is provided for the main body. A protruding portion 166, which forms the contact with respect to the receptacle contact 61, is provided at the forward end of an arm 164.

An explanation will be made with reference to FIGS. 9 to 11 about the installation of the plug contacts 161 to the plug connector 2. The tails 163 are directed toward the mounting side, the protruding portions 166 are inserted into the openings 116, and the plug connector 161 is pressed from the lower side of the plug connector 2. As a result, the fixing portions 165 bite into the housing 111, and the plug contacts 161 are installed to the plug connector 2. In this situation, the parts of the protruding portions 166 protrude to the outside of the housing 111 from the slits 117, and the tails 163 protrude to the outside of the housing 111 from the openings 116. The tails 163 are soldered to the board 191 to connect the board 191 and the plug connector 2 electrically and physically.

Examples of the sizes of the receptacle connector 1 and the plug connector 2 manufactured are shown below. The housing 11 of the receptacle connector 1 has sizes of longitudinal dimension (X direction): about 3.2 [mm], lateral dimension (Y direction): about 11 [mm], and thickness (Z direction): about 2.7 [mm]. The space 13 has a size of width (X direction): about 1.5 [mm]. The lateral groove 21 formed on the bottom plate 17 had a width (X direction): about 0.1 [mm] and a depth (Z direction): about 0.1 [mm]. The base 112 of the plug connector 2 has sizes of longitudinal dimension (X direction): about 2.6 [mm], lateral dimension (Y direction): about 7.2 [mm], and thickness (Z direction): about 3.3 [mm]. The insertion portion 113 has sizes of longitudinal dimension (X direction): about 1.5 [mm], lateral dimension (Y direction): about 6.6 [mm], and thickness (Z direction): about 8.6 [mm]. Both of the plurality of, i.e., fifteen first receptacle contacts 61*a* and the plurality of, i.e., fifteen second receptacle contacts 61*b*, which are provided for the receptacle connector 1, are provided at pitches of about 0.4 [mm]. The same number of the plug contacts 161, which are formed for the plug connector 2, are provided at the same pitches as those of the receptacle connector 1 corresponding thereto. The size of the housing and the pitch and the number of the contacts can be appropriately changed.

In the Present Application, each of the receptacle connector 1 and the plug connector 2 is molded by injection-molding the liquid crystal resin (LCP). LCP has the high orientation, and the melted resin thereof is solidified in a short period of time. Therefore, the weld lines tend to appear with ease. However, the range, in which the weld lines 30 appear, can be limited to the interior of the lateral groove 21 in the vicinity of the through-holes 18*a*. The high-function resin including, for example, liquid crystal resin, polyamide, and polyphenylene sulfide (PPS), which is excellent in the chemical resistance and the heat resistance, is used for the housing of the electrical connector. In general, the high-function resin as described above is difficult to be molded, wherein the weld lines tend to appear with ease. However, even when such a high-function resin is used, the range, in which the weld lines appear, can be restricted to the interior of the lateral groove 21.

An explanation will be made with reference to FIG. 12 about the mating between the receptacle connector 1 and the plug connector 2. The mating is performed as follows. That is, the surface of the receptacle connector 1, which is disposed on the mating side (upper side as viewed in FIG. 2), is matched to the surface of the plug connector 2 which is disposed on the mating side (upper side as viewed in FIG. 9). The protruding shape, which is composed of the insertion portion 113 of the plug connector 2, is fitted or mated into the recessed shape which is composed of the space 13 of the receptacle connector 1. In this situation, the plurality of plug contacts 161, which are provided for the plug connector 2, are elastically brought in contact with the plurality of receptacle contacts 61 which are provided for the receptacle connector 2 respectively, and they are electrically connected to each other.

In the Present Application, the lateral groove 21 is formed in the vicinity of the through-holes 18*a* which are arranged along the inner surface 121*a* of the lateral wall 12*a* (surface for defining the space 13). However, it is not necessarily indispensable that the through-holes should be arranged along the wall. For example, even in the case of any through-hole formed on a flat surface having no projection and no recess, there is such a possibility that any weld line may appear in the vicinity thereof. Therefore, when the groove is formed at the position at which the weld line appears in the vicinity of the through-hole, it is possible to provide the effect of the Present Application. The weld line appears during the injection molding at the portion at which the flows of the melted resin merge into one in the mold. Therefore, the position, at which the weld line appears, can be determined experimentally or in accordance with the calculation based on, for example, the shape of the mold and the position of the gate.

In the Present Application, the lateral groove 21 is formed in the vicinity of the through-hole 18*a* on the upper surface 17U of the bottom plate. However, the lateral groove 21 may be formed in the vicinity of the through-hole 18*a* on the lower surface 17B of the bottom plate. There is such a possibility that the weld line may appear in the vicinity of the through-hole. Therefore, the formation of the groove on the lower surface of the bottom plate is effective as well. Therefore, even when the groove or grooves is/are formed on the upper surface 17U and/or the lower surface 17B of the bottom plate along another array of the through-holes 18*b* formed for the bottom plate 17, the effect of the Present Application is also provided.

In the Present Application, the first receptacle contacts 61*a* are pressed-in via the through-holes 18*a* into the upper surface 17U of the bottom plate from the lower surface 17B of the bottom plate, and the lateral groove 21 is formed on the upper surface 17U of the bottom plate corresponding to the exit. However, the lateral groove 21 may be formed on the lower surface 17B of the bottom plate corresponding to the entrance. When the contacts are pressed-in into the housing, the force (force directed from the entrance side to the exit side), which is in the direction to strip off the weld lines upwardly, acts on the surface disposed on the exit side. Therefore, the crack tends to appear most easily in the vicinity of the through-hole disposed on the exit side. However, it is also feared that the crack may appear on the entrance side. When the groove is formed on the entrance side, the range, in which the crack appears, can be limited to the interior of the groove.

In the Present Application, the lateral groove 21 is formed as one continuous groove disposed along the arrangement of the through-holes 18*a*. However, a plurality of discontinuous grooves (recesses) may be formed for the plurality of through-holes 18*a* individually or for every several through-holes 18*a*. In the case of one continuous groove, the shape of the mold for molding the housing 11 is simple, which has a merit in view of the production method. However, the effect of the Present Application is also provided even in the case of the plurality of discontinuous grooves.

In the Present Application, the lateral groove 21 is the groove having the rectangular cross section. However, the cross section of the groove may be any shape other than the rectangular shape, including, for example, triangular, trapezoidal, circular, and elliptical shapes.

In the Present Application, the electrical connector 3 is the board-to-board connector. However, it is not necessarily indispensable that the electrical connector 3 should be the board-to-board connector. The effect of the Present Application is also provided in the case of any connector in which the through-holes are formed for the housing, and the contacts (connector terminals) are pressed-in into the through-holes.

In the electrical connector of the Present Application, the range, in which the weld lines appear in the vicinity of the through-holes for inserting the contacts thereinto, is limited in the housing. Therefore, the strength and the durability of the housing are improved in the vicinity of the through-holes. Therefore, the electrical connector of the Present Application can be effectively utilized as the connector to electrically connect the parts such as the boards or the like in the small-sized electronic device.

While a preferred embodiment of the Present Application is shown and described, it is envisioned that those skilled in the art may devise various modifications without departing from the spirit and scope of the foregoing Description and the appended Claims.

What is claimed is:

1. An electrical connector, the electrical connector comprising:

a first connector, the first connector including a first housing, the first housing being formed by injection molding of a thermoplastic resin;

a second connector, the second connector being electrically connected to the first connector;

a plurality of first connector terminals attached to the first housing, each first connector terminal comprising a substantially L-shaped main body and a tail;

a plurality of through-holes arranged in the first housing in a predetermined direction, each through-hole receiving one of the first connector terminals; and a recess formed adjacent the plurality of through-holes, the recess extending at least the length of the through-holes in the predetermined direction, the recess including a plurality of weld lines, each weld line being formed by the injection molding of the first housing.

2. The electrical connector of claim 1, wherein the first housing includes a first pair of mutually opposing walls, a second pair of mutually opposing walls and a bottom plate which bridges the first pair of mutually opposing walls and second opposing walls, respectively, so that a space is defined by the first pair of mutually opposing walls, the second pair of mutually opposing walls and the bottom plate.

3. The electrical connector of claim 2, wherein the through-holes are formed at portions on the bottom plate disposed in the vicinity of at least one of the first and second pairs of mutually opposing walls, and arranged along the at least one wall among the first and second pairs of mutually opposing walls.

4. The electrical connector of claim 3, wherein the recess is formed on a surface of the bottom plate, the surface defining the space.

5. The electrical connector of claim 4, wherein the recess comprises a groove extending in the predetermined direction adjacent the arrangement of the through-holes.

6. The electrical connector of claim 1, wherein the recess is formed on a surface of the first housing.

7. The electrical connector of claim 1, wherein the first connector terminals are attached to the first housing by being inserted into the through-holes.

8. The electrical connector of claim 6, wherein the first connector terminals are attached to the first housing by being inserted into the through-holes from a side of an opposite surface of the surface of the first housing.

9. A connector electrically mated to another connector, the connector comprising:

a housing, the housing being formed by injection molding of a thermoplastic resin;

a plurality of connector terminals attached to the housing, each connector terminal comprising a substantially L-shaped main body and a tail;

a plurality of through-holes formed in the housing and arranged in a predetermined direction, each through-hole receive one of the connector terminals; and a recess formed adjacent the plurality of through-holes, the recess extending at least the length of the through-holes in the predetermined direction, the recess including a plurality of weld lines, each weld line being formed by the injection molding of the first housing.

* * * * *